US005713761A

United States Patent [19]

Okayasu

[11] Patent Number: 5,713,761

[45] Date of Patent: Feb. 3, 1998

[54] ELECTRICAL CONNECTOR WITH WATER DIVERSION MEMBERS

[75] Inventor: Yasushi Okayasu, Yokkaichi, Japan

[73] Assignee: Sumitomo Wiring Systems, Ltd., Japan

[21] Appl. No.: 589,540

[22] Filed: Jan. 22, 1996

[30] Foreign Application Priority Data

Feb. 17, 1995 [JP] Japan ..... 7-053330

[51] Int. Cl.[6] ..... H01R 13/40

[52] U.S. Cl. ..... 439/595; 439/271; 439/732

[58] Field of Search ..... 439/595, 744, 439/271–274, 206, 732, 685, 181, 587, 589, 752

[56] References Cited

U.S. PATENT DOCUMENTS

| | | | |
|---|---|---|---|
| 4,806,123 | 2/1989 | Konishi et al. | 439/595 |
| 4,973,268 | 11/1990 | Smith et al. | 439/595 |
| 4,986,758 | 1/1991 | Wakata | 439/595 |
| 5,129,843 | 7/1992 | Bowsky et al. | 439/685 |
| 5,324,208 | 6/1994 | Kodama et al. | 439/271 |
| 5,529,515 | 6/1996 | Ohtaka et al. | 439/595 |

FOREIGN PATENT DOCUMENTS 5-30031 5/1993 Japan .

*Primary Examiner*—Neil Abrams
*Assistant Examiner*—Brian J. Biggi
*Attorney, Agent, or Firm*—Banner & Witcoff, Ltd.

[57] ABSTRACT

An electrical connector is formed with a plurality of cavities in an ordered way in a housing. A retainer is fitted to the housing to cover the front faces of the cavities. The retainer doubly stops the female terminals by means of deformation regulating members provided therein, each of which enters a recessed portion of a respective lance, thereby regulating its deformation. The lances are associated with the cavities. The front face plate of the retainer has apertures formed thereon that align with the terminal insertion apertures located on the front face of the cavities. Ribs are formed between the apertures and project outwards, partitioning the apertures. Grooves that fit with the ribs are formed on the insertion face of a complementary connector. The creeping distance between the adjacent cavities is increased due to the provision of the ribs.

8 Claims, 6 Drawing Sheets

ELECTRICAL CONNECTOR WITH WATER DIVERSION MEMBERS

BACKGROUND OF THE INVENTION

1. Field of the Invention

This invention relates to an electrical connector provided with a front-mounted retainer, and in particular to an electrical connector having an increased creeping distance between its sockets.

2. Prior Art

It is known to hold a terminal firmly in a housing using a doubly-stopped retainer. For a water-proof electrical connector, a common double-stopping system utilises a front-mounted retainer, that is to say one which is inserted from the front of the connector housing. A front-mounted retainer is generally used because it is undesirable to provide an opening for attachment of a retainer on the side of a connector housing. FIGS. 8 and 9 of the drawings show an example of a front-mounted retainer 63, together with an associated female electrical connector 61. The connector 61 includes a main body 61*a* formed with a plurality of parallel sockets 62 into which female terminals are insertable. The retainer 63 is attached to the main body 61*a* from its front so that it covers the front portion of the main body after attachment. The retainer 63 is formed with apertures 64 which align with the sockets 62 when the retainer is attached to the connector 61. A pin of a respective terminal of a corresponding male connector (not shown) fits into each aperture 64. The retainer 63 is provided with a respective deformation regulating member 67 within each aperture 64. In use, each of the members 67 enters a recessed portion 66 of a respective lance 65 provided in each of the sockets 62.

During assembly, when a female terminal is inserted into its socket 62, the corresponding lance 65 serves as a first stop by resilient engagement therewith. Then, as shown in FIG. 9, when the retainer 63 is attached, each deformation regulating member 67 enters the recessed portion 66 of the respective lance 65, thereby preventing it from bending. The deformation regulating member 67 thereby serves as a second stop, and consequently double-stopping is effected.

Where this type of connector comes in contact with water, and water reaches the mouths of its sockets 62 so that a film of water covers the spaces between the sockets, there is a danger of electrical shorting between proximally located terminals via the film of water. One way of reducing the chance of this happening, is to provide ribs between adjacent sockets 62 on the front surface of the main body 61*a*. The ribs thus define tortuous water flow paths between adjacent sockets (by increasing the "creeping distance" therebetween), thereby preventing a film of water from extending continuously over the adjacent sockets 62, and so preventing an electrical short.

Unfortunately, as the ribs are formed on the front surface of the main body 61*a*, there is a danger of the ribs breaking during, for example, transportation. Moreover, where a front-mounted retainer is used, the ribs get in the way during attachment of the retainer, making it difficult to attach the retainer.

The aim of the invention is to provide an electrical connector which has an increased creeping distance between its sockets, even when the connector is used with a front-mounted retainer.

SUMMARY OF THE INVENTION

The present invention provides an electrical connector comprising a housing, a plurality of parallel cavities formed in the housing for receiving terminals, and a retainer fitted to the housing from a first end thereof, a respective resilient lance being provided in each of said cavities, each lance being formed with a recess portion, the lances resiliently engaging terminals positioned in said cavities as the retainer is fitted to the housing, the lances thereby constituting first terminal stop means, the retainer being formed with a plurality of terminal insertion apertures which open onto a front face of the retainer and are contiguous with said cavities, and a respective deformation regulating member is provided for each terminal insertion aperture, the deformation regulating members being insertable into the recessed portions of the lances as the retainer is fitted to the housing, thereby regulating the deformation of the lances to constitute second terminal stop means, characterised in that the front face of the retainer is formed with elongate water diversion members between the adjacent terminal insertion apertures.

Since the water diversion members are provided between the terminal insertion apertures that are adjacently located on the front face of the retainer, when the retainer is attached to the housing, the creeping distance between the cavities, which are formed so as to be continuous with the terminal apertures, is increased. In other words, the connector of the invention allows, even in the case where a front-mounted retainer is used, an increase in the creeping distance between the cavities, and the effective prevention of electric shorting between terminals inserted into said cavities.

In a preferred embodiment the elongate water diversion members mate with complementary members formed on a face of complementary connection means to which the connector is to be connected. In this case, when the connector, having the retainer attached thereto, is fixed to the complementary connection means, the water diversion members of the retainer mate with the complementary members of the connection means. This results in the connector being fixed to the connection means with the front face of the retainer and an insertion face of the connection means making contact. In addition, the connector fits snugly with the connection means since, when the connection means is inserted, the retainer matingly engages the connection means.

The elongate water diversion members may comprise ribs or recesses.

Advantageously, the elongate water diversion members comprise upstanding ribs, thus arrangement permitting a more compact arrangement of terminal insertion apertures. This arrangement is especially advantageous where the complementary connection means comprises an injection moulded connector having protruding male terminals. Such terminals are relatively far apart and thus the terminal housing is able to accommodate corresponding recesses to receive the upstanding ribs of the retainer without increasing the spacing of adjacent terminals which would result in an enlarged connector.

Preferably, the retainer and the connector housing are provided with inter-engageable means for locking the retainer to the housing. The inter-engageable means may be constituted by claw members formed on the retainer and stop members formed on the housing, and by projections formed on the retainer and grooves formed within the housing.

The housing and the retainer may each be integrally moulded from a synthetic resin material. The cavities may be defined by tubular members integrally moulded with the housing.

Preferably, the connector is a female connector, a respective female terminal being positioned in each of said cavities.

The invention also provides a connector assembly comprising a female connector as defined above and a complementary male connector, the male connector being provided with male terminals for engagement within the female terminals.

Advantageously, the male connector and the female connector are provided with inter- engageable means for locking the two connectors together.

BRIEF DESCRIPTION OF THE DRAWINGS

The invention will now be described in greater detail, by way of example, with reference to FIGS. 1 to 7 of the drawings, in which.

DESCRIPTION OF PREFERRED EMBODIMENT

Figure 1:
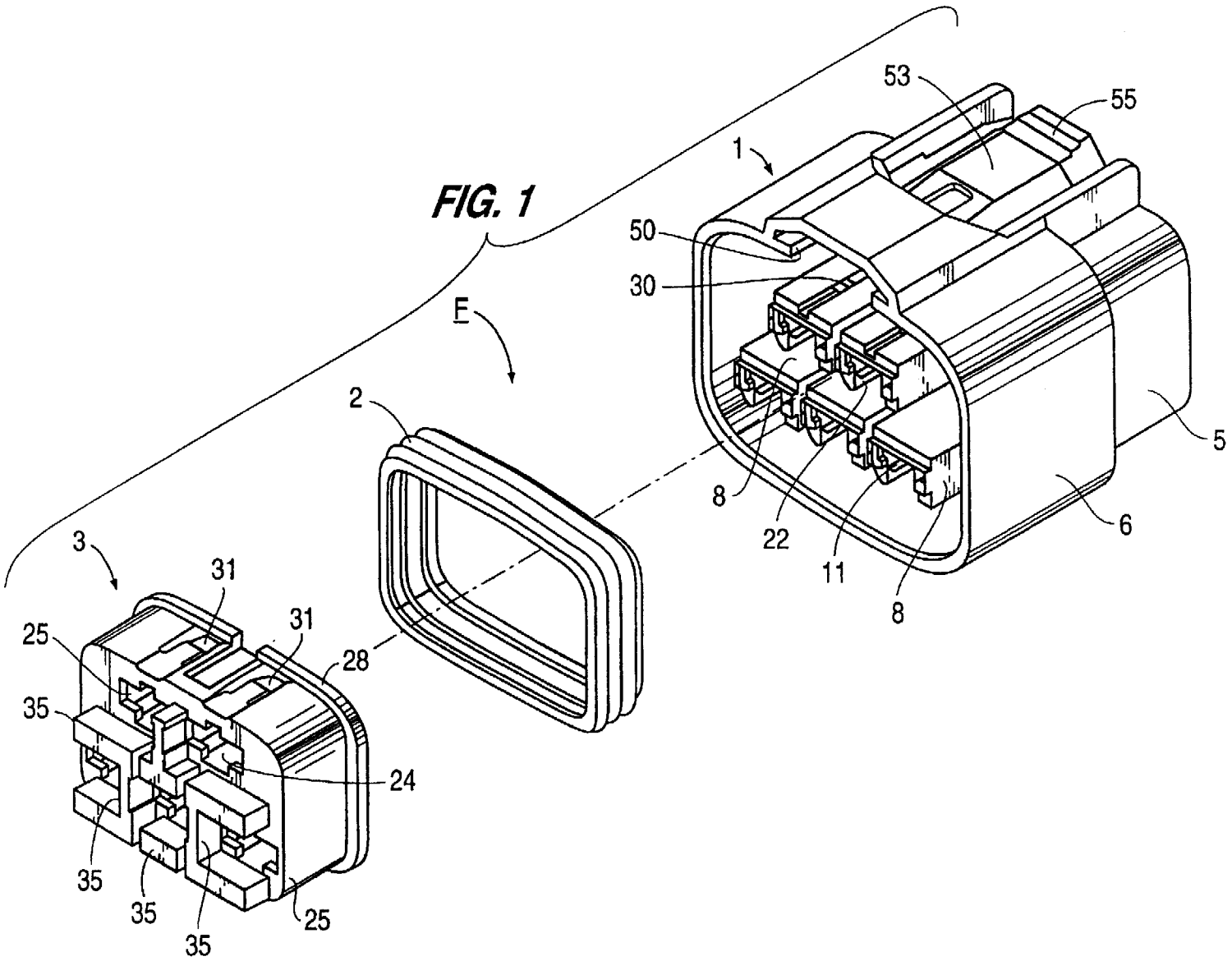
FIG. 1 is an exploded perspective view of a female connector constructed in accordance with the invention.

Referring to the drawings, FIG. 1 shows a water-proof female connector F comprising a housing 1, a water-proof seal 2 and a retainer 3.

Figure 2:
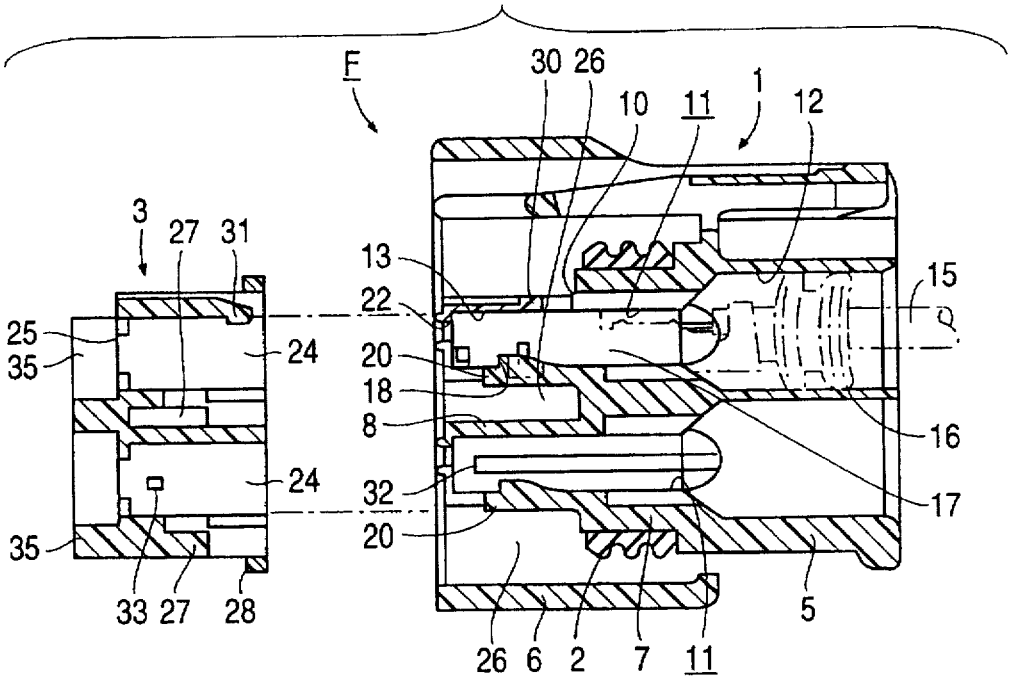
FIG. 2 is a longitudinal sectional view showing the connector of FIG. 1 prior to the attachment of its retainer.

The housing 1, which is integrally moulded using synthetic resin material, has a main body 5, from which an inwardly-stepped front portion 7 extends (towards the left in FIG. 2). This front portion 7 is covered by a hood member 6. The main body 5 is of a generally rectangular configuration when seen from the front. Five generally tubular members 8 project from the front face of the main body 5, three of the tubular members forming a lower level, and the remaining two members forming an upper level. The tubular members 8 of the upper level are located above the spaces between the three tubular members of the lower level.

The hood member 6 is also of a generally rectangular configuration when seen from the front.

As shown in FIG. 2, the main body 5 is formed with sockets 11 for receiving female terminals 10, the sockets each extending from the rear face of the main body to the front face of a respective tubular member 8. The rear of each socket 11 defines a circular aperture 12, and the front thereof defines a generally rectangular aperture 13. Each terminal 10 is connected to a respective electrical wire 15, and a respective water-proof rubber seal 16 is fitted tightly into each circular aperture 12 around the respective electrical wire. Each terminal 10 is formed with a box-shaped main body 17 which fits within a respective aperture 13.

A respective lance 20 is formed on that surface of each socket 11 which defines the base of the associated aperture 13. Each lance 20 is a resilient fit within an aperture 18 formed in the lower surface of the main body 17 of the associated female terminal 10. Each lance 20 is resiliently deformable in the direction of a recessed portion 26 formed on its underneath surface. Each socket 11 is formed with terminal insertion aperture 22 at its front end. Each terminal insertion aperture 22 is arranged to receive a pin 46 of a male terminal 45, to be described later.

The water-proof seal 2 is made of rubber, and is generally rectangular when seen from the front. The water-proof seal 2 is arranged to fit around the front portion 7 of the main body 5 of the housing 1.

The retainer 3 is also integrally moulded from synthetic resin material. In use, it covers the periphery of the tubular members 8 of the housing 1, and fits around the front portion 7 of the main body 5. The rear face of the retainer 3 (the right-hand side in FIG. 2) is formed with five insertion apertures 24 which receive the respective tubular members 8. Each insertion aperture 24 is formed with a mouth 25 which fits around a respective terminal insertion aperture 22 of an associated socket 11. A respective deformation regulating member 27 is provided on that surface of the retainer 3 defining the base of each insertion aperture 24. When the retainer 3 is attached to the housing 1, each deformation regulating member 27 enters the recessed portion 26 of the lance 20 provided in the respective socket 11, thereby regulating the deformation of that lance.

A flange 28 is formed on the periphery of the rear face of the retainer 3, the flange serving to stop the attached water-proof seal 2 from coming loose. A respective resilient stop claw 31 is formed on that surface of the retainer 3 defining the top of each of the upper two insertion apertures 24. The stop claws 31 are arranged to engage behind corresponding stops 30 formed on the upper surfaces of the two upper tubular members 8 of the housing 1. Projections 33 are formed on the opposite side faces of the centrally-located lower insertion aperture 24. The projections 33 are arranged to fit within grooves 32 formed on the external side surface of the corresponding tubular member 8.

Figure 3:
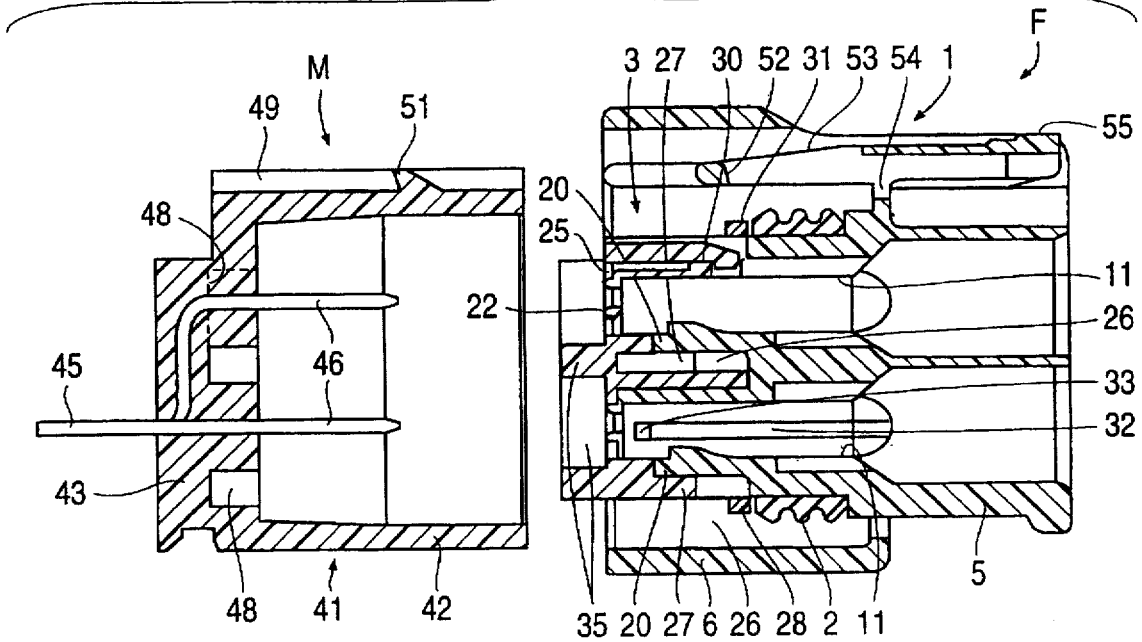
FIG. 3 is a longitudinal sectional view showing the connector of FIG. 1 prior to the attachment of a complementary male connector.
Figure 4:
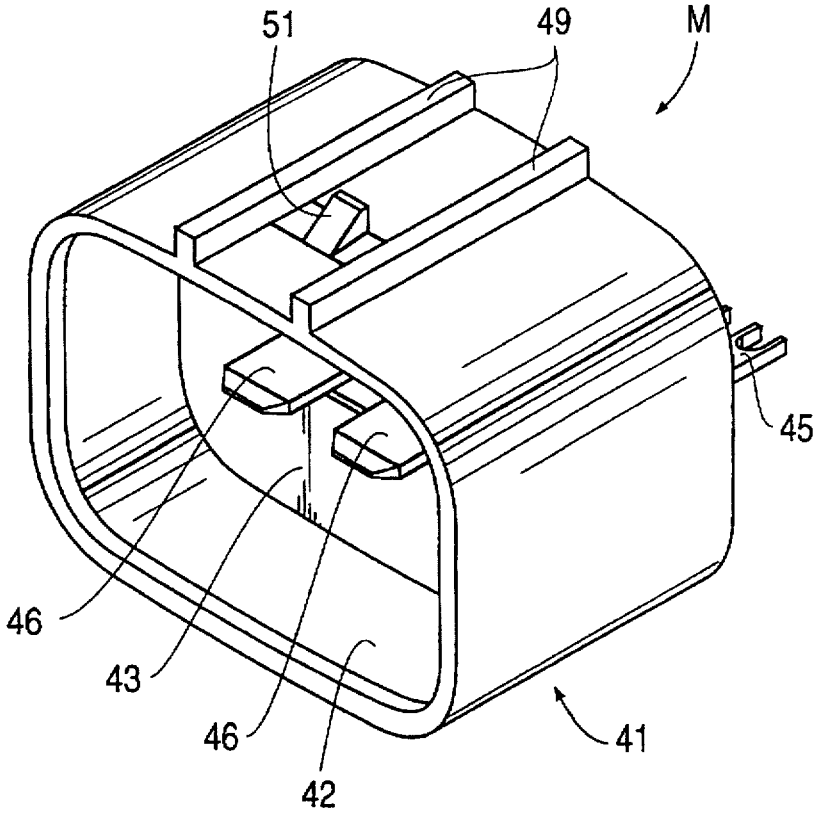
FIG. 4 is a perspective view showing the male connector.
Figure 5:
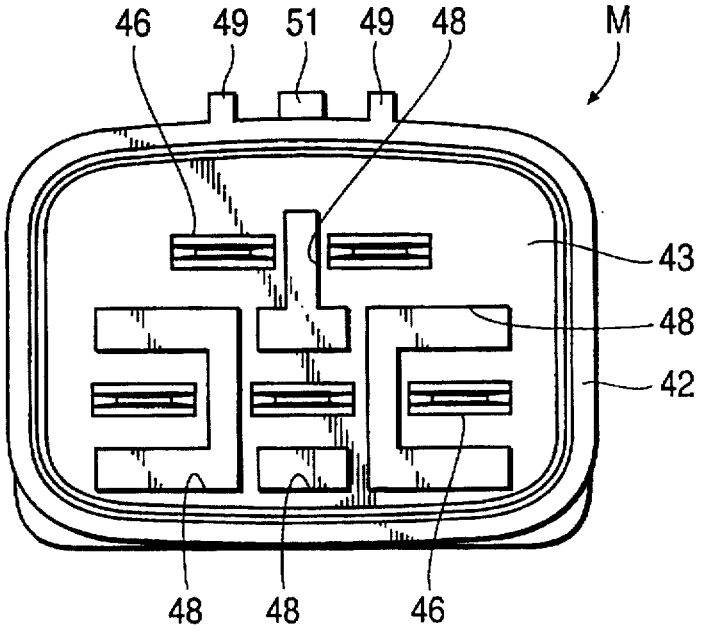
FIG. 5 is a front elevation of the male connector.

As shown in FIG. 3, when the retainer 3 is inserted, and the tubular members 8 of the housing 1 enter the respective insertion apertures 24, the resilient stop claws 31 engage behind the stops 30 as the rear of the retainer strikes the shoulder between the inwardly-stepped front portion 7 and the main body 5 of the housing 1. Furthermore, the projections 33 fit into the grooves 32, thereby attaching the retainer 3 firmly to the housing 1. At this point, the front surface of the retainer 3 is aligned with the front ends of the tubular members 8 and with the front end of the hood member 6. Each tubular member 8 is inserted into the respective insertion aperture 24 until the respective terminal insertion aperture 22 fits within the associated mouth 25 of the retainer 3. Moreover, each deformation regulating member 27 enters the recessed portion 26 of the respective lance 20.

The front face of the retainer 3 is provided with integrally-formed ribs 35 which project therefrom over a predetermined distance. As shown in FIG. 1, the ribs 35 are located between the mouths 25 of the apertures 24, and are formed so as to separate the five mouths.

FIGS. 3 to 6 show a male connector M that is to be fitted to the female connector F. The male connector M has a housing 1 made of synthetic resin material, the housing having a generally rectangular tubular portion 42, opening out to the front (the right-hand side in FIG. 3). The housing 41 has a thick rear face plate 43 integrally formed with the hollow portion 42. The hollow portion 42 is arranged to be insertable between the hood member 6 of the housing 1 and the front portion 7 of the main body 5 of the female connector F. Pins 46 of five male terminals 45 are provided on the inner wall of the rear face plate 43 of the housing 41 so as to project within the hollow portion 42. The male terminals 45 are installed by means of insert moulding, and their other terminal ends project outwardly in a single line from the outer wall of the rear face plate 43.

The inner wall of the rear face plate 43 is formed with grooves 48 provided between the pins 46. The grooves 48 are arranged to mate with the ribs 35.

The upper surface of the housing 41 is formed with a pair of mutually-parallel, longitudinally-extending projections 49 which, in use, mate with corresponding grooves 50 formed in the upper surface of the housing 1. A stop member 51 is formed between the two projections 49 of the housing 41, this stop member engaging, in use, with an aperture 52 formed in a resilient stop member 53 provided between the grooves 50 of the housing 1. As shown in FIG. 3, the stop member 53 is resiliently deformed when the male connector M is fully engaged within the female connector F, the stop member 53 being formed with a central support member 54. Consequently, when the housing 41 of the male connector M is inserted, the stop member 53 strikes the member 51 and is deformed resiliently to push its front end upwards. This allows the insertion to proceed. After the insertion proceeds up to a specified point, the stop member 53 reverts to its original shape, as the stop member 51 enters the aperture 52. This prevents the housing 41 from being removed.

A manually-engageable tab 55 is provided at the rear end of the stop member 53. In order to release the male connector M, the tab 55 is depressed thereby resiliently deforming the stop member 53 to force its front end upwards. This results in the stop member 51 coming out of the aperture 52, thereby releasing the engagement with the stop member 53.

In order to assemble the female connector F, the water-proof seal 2 is fitted around the front portion 7 of the main body 5 of the housing 1. The female terminals 10 are then inserted into the sockets 11, from the rear side thereof. Each female terminal 10 pushes the associated lance 20 downward, thereby resiliently deforming it. When each female terminal 10 reaches the front end of its socket 11, and the respective lance 20 reverts to its original shape and enters the respective aperture 18, thereby resulting in a first stop for the female terminal 10. At the juncture, each water-proof seal 16 fixed around its electrical wire 15 fits tightly into the respective circular aperture 12, thereby water-proofing the sockets 11.

After the insertion of the female terminals 10 is complete, the retainer 3 is attached to the housing 1 from the front side thereof. As described earlier, as the retainer 3 is inserted, the tubular members 8 of the housing 1 enter the corresponding insertion apertures 24. As shown in FIG. 3, when the retainer 3 comes into contact with the front portion 7 of the main body 5 of the housing 1, the stopping claws 31 are stopped by the stop member 30. Moreover, the projections 33 are stopped in the grooves 32, thereby preventing removal of the retainers. At this point, the terminal insertion aperture 22 of each socket 11 enters the mouth 25 of the respective retainer 3. Furthermore, each deformation regulating member 27 of the retainer 3 regulates the deformation of the associated lance 20 by entering the recessed portion 26 thereof. This results in the female terminals 10 being doubly stopped.

If a female terminal 10 is in a half-inserted position, the respective lance 20 projects outwards from the associated recessed portion 26, and the deformation regulating member 27 strikes that lance, thereby preventing the retainer 3 from being pushed into the fully-inserted position. This allows detection of incomplete insertion of a terminal fitting 10.

Once the retainer 3 is correctly positioned, the flange 28 rests against the front face of the water-proof seal 2, thereby maintaining the water-proof seal in its correct position. Moreover, if the water-proof seal 2 is positioned forwardly of its correct position, it is pushed by the flange 28, when the retainer 3 is inserted, into the correct position.

Figure 6:
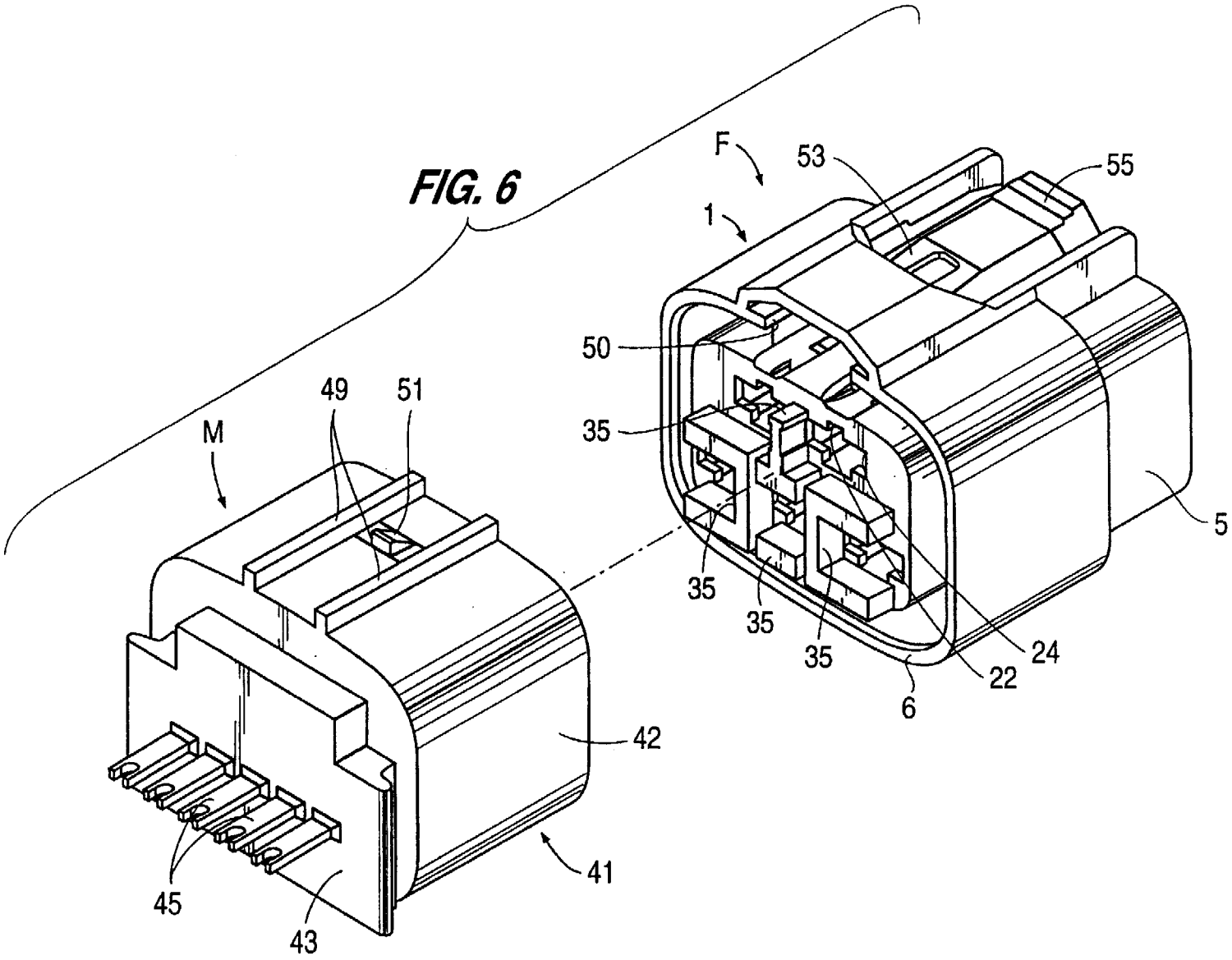
FIG. 6 is a perspective view showing the connector of FIG. 1 prior to the attachment of the male connector.

The female connector F and the male connector M are then connected, after they are put to face each other as shown in FIGS. 3 and 6. The housing 41 of the male connector M is guided by the engagement of the projections 49 and the grooves 50; and the hollow portion 42 thereof is inserted between the retainer 3 and the hood member 6 of the housing 1 of the female connector F. The ribs 35 provided on the front face of the retainer 3 mate with the grooves 48 provided on the rear face plate 43 of the housing 41.

Figure 7:
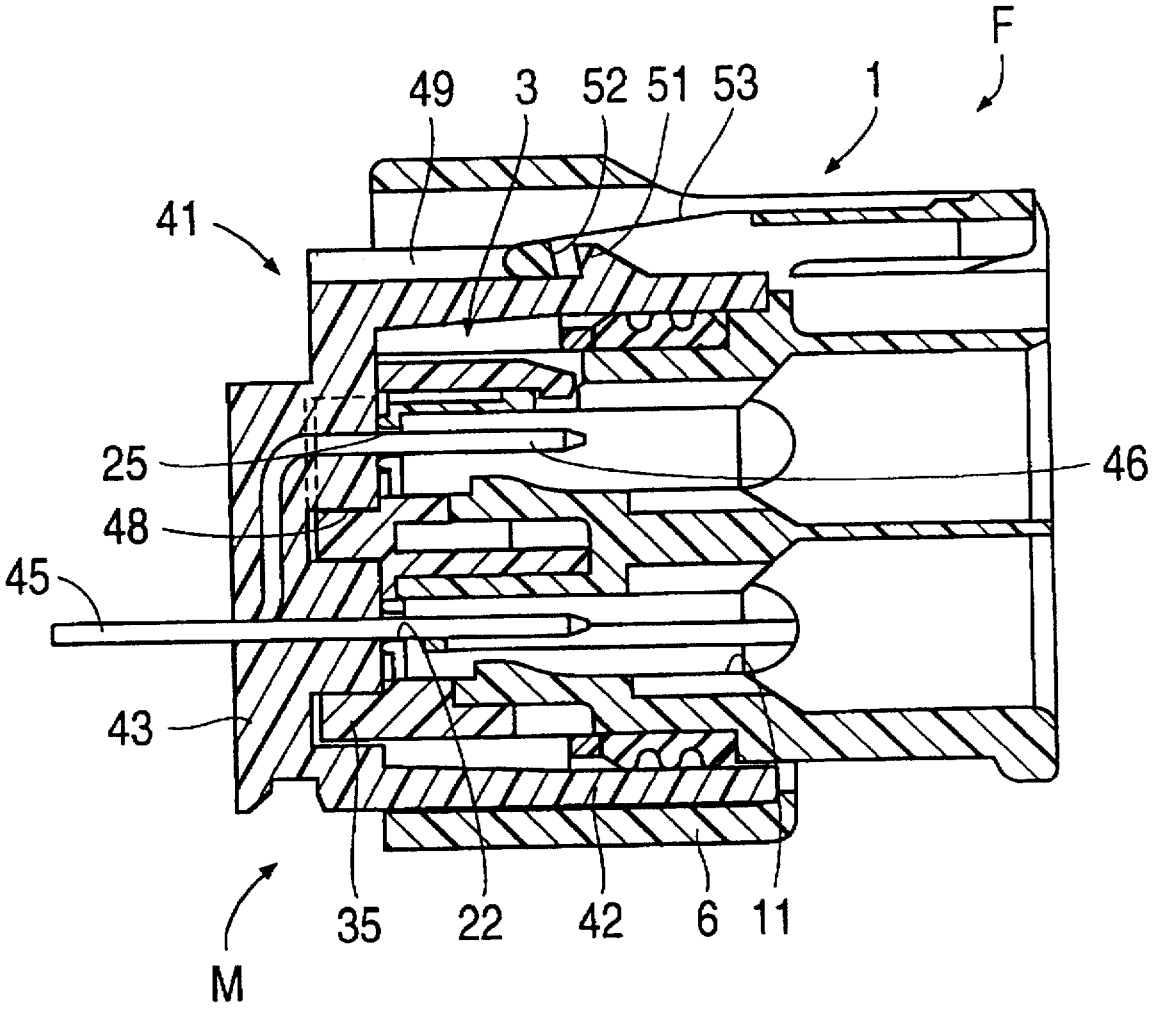
FIG. 7 is longitudinal sectional view showing the connector of FIG. 1 after the attachment of the male connector.
Figure 8:
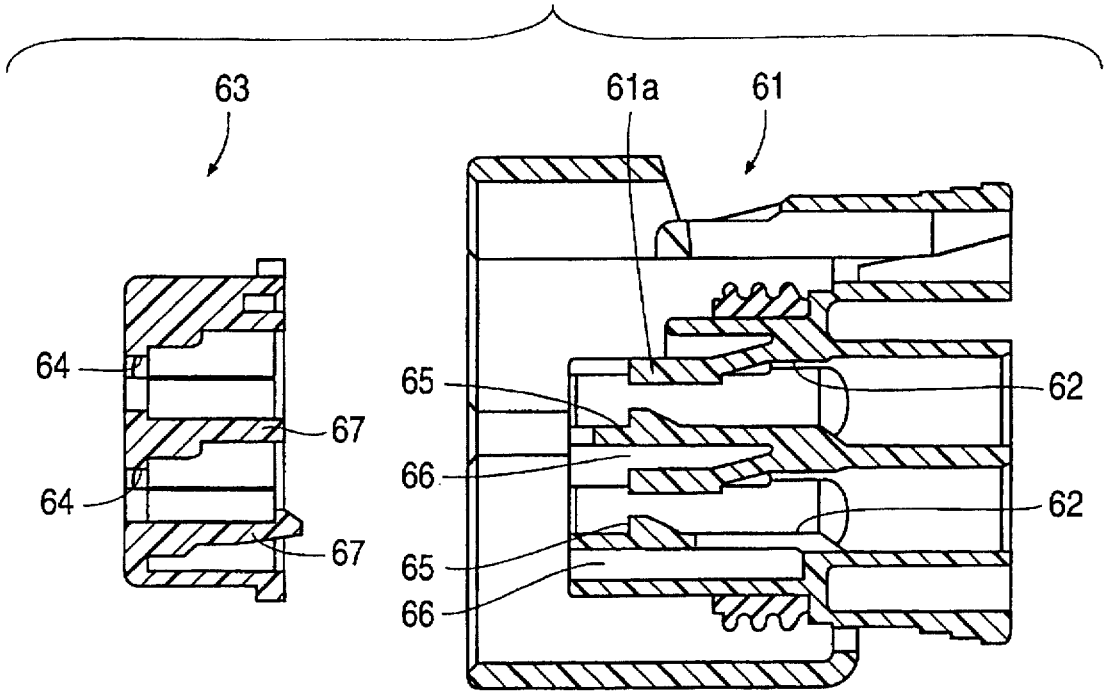
FIG. 8 PRIOR ART
FIGS. 8 and 9 are sectional views of an electrical connector known in the prior art.
Figure 9:
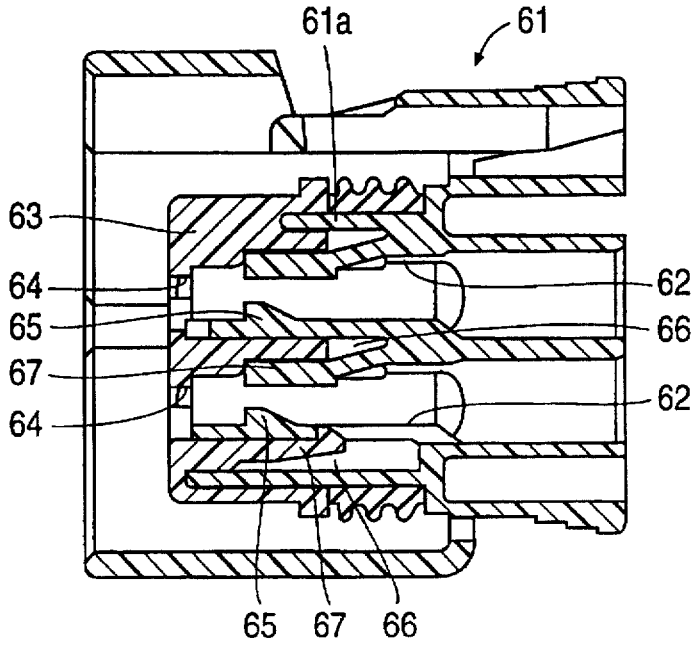
FIG. 9 PRIOR ART

As shown in FIG. 7, when the front face of the retainer 3 comes in contact with the inner wall of the rear face plate 43 of the housing 41, as described earlier, the stop member 51 of the housing 41 enters the aperture 52 provided in the stop member 53 of the housing if resulting in the male connector M and the female connector F being fitted together. At the same time, each pin 46 passes through the respective terminal insertion aperture 22 inside each aperture 24 of the retainer 3, and is inserted into the main body 17 of the respective female terminal 10. Accordingly, each male terminal 45 is connected to the corresponding female terminal 10. Moreover, when the male connector M and the female connector F are connected together, the front end of the hollow portion 42 of the housing 41 pushes the water-proof seal 2 onto the exterior of the front portion 7 of the main body 5 of the housing 1. As a result, water-proofing between the female housing 1 and male housing 41 is ensured.

Furthermore, even after providing the water-proofing means described above, there is a possibility of there being a water leak towards, for example, the front face of the housing 1. In order to prevent this, the ribs 35 are provided between the mouths 25 of the insertion apertures 24 of the retainer 3, each mouth 25 being contiguous with a respective socket 11 of the housing 1. Accordingly, the configuration is such as to allow a large creeping distance between the sockets 11. Consequently, if water does enter the insertion face of the housing 1, a film of water is prevented from forming between the front faces of the adjacent sockets 11 by the tortuous paths defined by the ribs 35. As a result, electrical shorting between adjacent terminal fittings can be effectively prevented. It will be apparent that, even a for a connector having a front-mounted retainer, the creeping distance between its sockets can be made large, thereby improving leak-proofing.

The embodiment described above would be modified. For example, instead of providing the front face of the retainer 3 with ribs 35, it is possible to increase the creeping distance by making the front face of the retainer thick and forming grooves between adjacent mouths 25. In this case, it is desirable to provide projections on the insertion face of the corresponding male connector, the projections being arranged to mate with the grooves.

It would also be possible to provide a male connector with the described means for increasing the creeping distance—in this case the ribs or grooves would be provided between the pins 46.

Moreover, the present invention applies equally to a simplified water-proof connector, and has the same effect of improving leak-proofing.

I claim:

1. A connector assembly comprising a female connector and a complementary male connector, the female connector comprising a housing, a plurality of parallel cavities formed in the housing receiving female terminals, a retainer fitted to the housing from a first end thereof, and a respective resilient lance being provided in each of said cavities, each lance being formed with a recess portion, the lance resiliently engaging said female terminals positioned in said cavities as the retainer is fitted to the housing, the lances thereby constituting first terminal stop means, the retainer being formed with a plurality of terminal insertion apertures which open onto a front face of the retainer and are contiguous with said cavities, and a respective deformation regulating member provided for each terminal insertion aperture, the deformation regulating members being insertable into the recessed portions of the lances as the retainer is fitted to the housing, thereby regulating the deformation of the lances to constitute second terminal stop means, wherein the front face of the retainer has upstanding ribs between the adjacent terminal insertion apertures, the ribs constituting water diversion members between the adjacent terminal insertion apertures, and the male connector comprising a moulded housing, a plurality of male terminals for engagement within the female terminals, said male terminals being encapsulated and fixedly held by the moulded housing, and complementary recesses formed in the housing of the male connector for receiving the ribs on the front face of the retainer whereby the size of the connector assembly can be minimized.

2. A connector assembly as claimed in claim 1, wherein the retainer and the housing for the female connector are provided with inter-engagable means for locking the retainer to the housing.

3. A connector as claimed in claim 2, wherein the inter-engageable means is constituted by claw members formed on the retainer and stop members formed on the housing.

4. A connector as claimed in claim 3, wherein the inter-engageable means further comprises projections formed on the retainer and grooves formed within the housing.

5. A connector assembly as claimed in claim 1, wherein the housings for the male and female connectors are integrally moulded from a synthetic resin material.

6. A connector as claimed in claim 5, wherein the cavities are defined by tubular members integrally moulded with the housing of the female connector.

7. A connector as claimed in claim 1, wherein the retainer is integrally moulded from a synthetic resin material.

8. An assembly as claimed in claim 1, wherein the male connector and the female connector are provided with inter-engageable means for locking the two connectors together.

* * * * *